US010806963B2

(12) United States Patent
Staten

(10) Patent No.: US 10,806,963 B2
(45) Date of Patent: Oct. 20, 2020

(54) STORABLE BENCH

(71) Applicant: Rogers Athletic Company, Inc., Clare, MI (US)

(72) Inventor: Kenneth Edward Staten, Clare, MI (US)

(73) Assignee: Rogers Athletic Company, Inc., Clare, MI (US)

( * ) Notice: Subject to any disclaimer, the term of this patent is extended or adjusted under 35 U.S.C. 154(b) by 125 days.

(21) Appl. No.: 15/889,685

(22) Filed: Feb. 6, 2018

(65) Prior Publication Data

US 2018/0229072 A1 Aug. 16, 2018

Related U.S. Application Data

(60) Provisional application No. 62/457,468, filed on Feb. 10, 2017.

(51) Int. Cl.

| | |
|---|---|
| ***A63B 23/12*** | (2006.01) |
| ***A63B 21/078*** | (2006.01) |
| ***A63B 21/00*** | (2006.01) |

(52) U.S. Cl.

CPC ..... *A63B 21/4029* (2015.10); *A63B 21/078* (2013.01); *A63B 23/1218* (2013.01); *A63B 2210/50* (2013.01)

(58) Field of Classification Search

CPC ..... A63B 21/078; A63B 21/4029; A63B 23/1218; A63B 2210/50; A63B 21/0626; A63B 21/0783; A63B 23/50

See application file for complete search history.

(56) References Cited

U.S. PATENT DOCUMENTS

| | | | | |
|---|---|---|---|---|
| 4,369,966 | A | 1/1983 | Silberman et al. | |
| 4,624,457 | A | 11/1986 | Silberman et al. | |
| 5,882,283 | A | 3/1999 | Stevens | |
| 5,921,897 | A * | 7/1999 | Stevens | A63B 21/078 482/104 |
| 6,264,586 | B1 * | 7/2001 | Webber | A63B 21/078 482/104 |
| 6,371,896 | B1 * | 4/2002 | Kettler | A63B 21/078 297/13 |
| 6,645,130 | B2 | 11/2003 | Webber | |
| 6,685,601 | B1 * | 2/2004 | Knapp | A63B 21/078 482/104 |
| 7,717,836 | B1 * | 5/2010 | Miller | A63B 21/00 482/142 |
| 7,753,830 | B1 * | 7/2010 | Marsh | A63B 21/078 482/104 |

(Continued)

*Primary Examiner* — Loan B Jimenez
*Assistant Examiner* — Zachary T Moore
(74) *Attorney, Agent, or Firm* — Carlson, Gaskey & Olds, P.C.

(57) ABSTRACT

An exemplary exercise system includes, among other things, a bench extending longitudinally from a first end portion to a second end portion. The bench in pivotable about the first end portion from a training position to a stored position when the bench is attached to a rack. An exemplary method of storing a bench includes, among other things, securing a first end portion of a bench to a rack, the bench extending longitudinally from the first end portion to a second end portion. The method further includes pivoting the bench from a training position to a stored position while the first end portion is attached to the rack.

14 Claims, 5 Drawing Sheets

(56) References Cited

U.S. PATENT DOCUMENTS

| | | | | |
|---|---|---|---|---|
| 7,918,771 | B2 | 4/2011 | Rogers et al. | |
| 8,657,726 | B2 | 2/2014 | Rogers et al. | |
| 9,192,799 | B2 * | 11/2015 | Alenaddaf | A63B 71/0036 |
| 9,555,274 | B1 * | 1/2017 | Cassidy | A63B 21/0628 |
| 2003/0050157 | A1 * | 3/2003 | Teuscher | A63B 21/06<br>482/142 |
| 2003/0114281 | A1 * | 6/2003 | MacKert | A63B 21/4033<br>482/123 |
| 2005/0032614 | A1 * | 2/2005 | Keiser | A63B 21/4029<br>482/142 |
| 2016/0213966 | A1 * | 7/2016 | Chou | A63B 71/0036 |
| 2017/0001064 | A1 * | 1/2017 | Vorozilchak | A63B 21/4029 |
| 2017/0028246 | A1 * | 2/2017 | Vorozilchak | A63B 21/078 |

* cited by examiner

STORABLE BENCH

CROSS-REFERENCE TO RELATED APPLICATIONS

This application claims priority to U.S. Provisional Application No. 62/457,468, which was filed on 10 Feb. 2017 and is incorporated herein by reference.

TECHNICAL FIELD

This disclosure relates generally to equipment used when exercising and, in particular, an exercise bench.

BACKGROUND

Athletes and others use various exercises to develop and train areas of their bodies. Some exercises are performed with resistance provided by weights, such as barbells or machines. Other exercises utilize the athlete's body as resistance.

Various types of equipment have been developed to assist with exercises. Weight racks, for example, can be used to assist with strength training exercises such as squats and cleans. For some exercises, a bench is used instead of, or in addition to, the weight rack. Bench presses, incline presses, military presses, etc. with a bar can require both the bench and the weight rack. These exercises may require lifting the bar from a racked position on the weight rack. The bench can also be used for exercises involving free weights.

SUMMARY

An exercise system, according to an exemplary aspect of the present disclosure includes, among other things, a bench extending longitudinally from a first end portion to a second end portion. The bench is pivotable about the first end portion from a training position to a stored position when the bench is attached to a rack.

In another example of the foregoing system, the first end portion is vertically beneath the second end portion when the bench is in the stored position.

In another example of any of the foregoing systems, the bench rotates ninety degrees about the first end portion when transitioning from the training position to the stored position.

Another example of any of the foregoing systems includes a lever. When the bench is in the stored position, the lever holds a bar to secure the bench in the stored position.

In another example of any of the foregoing systems, the lever is biased toward an engaged position where the lever can hold the bar.

In another example of any of the foregoing systems, the lever is configured to be moved away from the engaged position by a force applied by a user.

In another example of any of the foregoing systems, the force is applied by a foot of a user.

Another example of any of the foregoing systems includes at least one leg of the bench. The at least one leg rests on a surface to support at least a portion of the bench when the bench is in the training position. The leg is elevated away from the surface when the bench is in the stored position.

In another example of any of the forgoing systems, the bench is moveable along the longitudinal axis when the bench is in the training position back and forth between an extended position and a retracted position.

Another example of any of the foregoing systems includes a bench base assembly of the bench. The bench base assembly includes at least one guide rail and a plurality of rollers. The plurality of rollers slide relative to the at least one guide rail as the bench is moved between the extended position and the retracted position.

Another example of any of the foregoing systems includes a bench seat and a bench back secured to a bench base, the bench seat and the bench back moveable relative to the bench base assembly back and forth between a flat position and a tilted position.

In another example of any of the foregoing systems, the bench seat and the bench back are configured to move together between the flat position and the tilted position.

In another example of any of the foregoing systems the tilted position is one a plurality of fixed tilted positions.

A method of storing a bench according to yet another exemplary aspect of the present disclosure includes, among other things, securing a first end portion of a bench to a rack, the bench extending longitudinally from the first end portion to a second end portion. The method further includes pivoting the bench from a training position to a stored position while the first end portion is attached to the rack.

In another example of the foregoing method, the first and second end portions are vertically aligned when the bench is in the training position, and the second end portion is vertically above the first end portion when the bench is in the stored position.

Another example of any of the foregoing methods includes holding the bench in the stored position by engaging a bar with a lever, the lever biased toward an engaged position with the bar.

In another example of any of the foregoing methods, when the bench is in the stored position, a user can rotate the lever to move the lever from the engaged position such that the bench can rotate from the stored position to the training position.

In another example of any of the foregoing methods, the lever is configured to move from the engaged position in response to a force applied by a foot of a user.

Another example of any of the foregoing methods includes transitioning the bench back and forth between a retracted position and an extended position when the bench is in the training position and is attached to the rack.

Another example of any of the foregoing methods includes tilting a bench seat and a bench back relative to a bench base when the bench is in the training position and is attached to the rack. The tilting moves the bench seat and the bench back relative to the bench base back and forth between a flat position and a tilted position.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

This disclosure relates generally to a bench for exercising. The bench can be attached to a rack and, when attached, moved between a training position and a stored position. In the stored position, the bench provides clearance for a user to utilize the rack to perform exercises that do not necessarily require the bench, such as squats and cleans.

Figure 1:
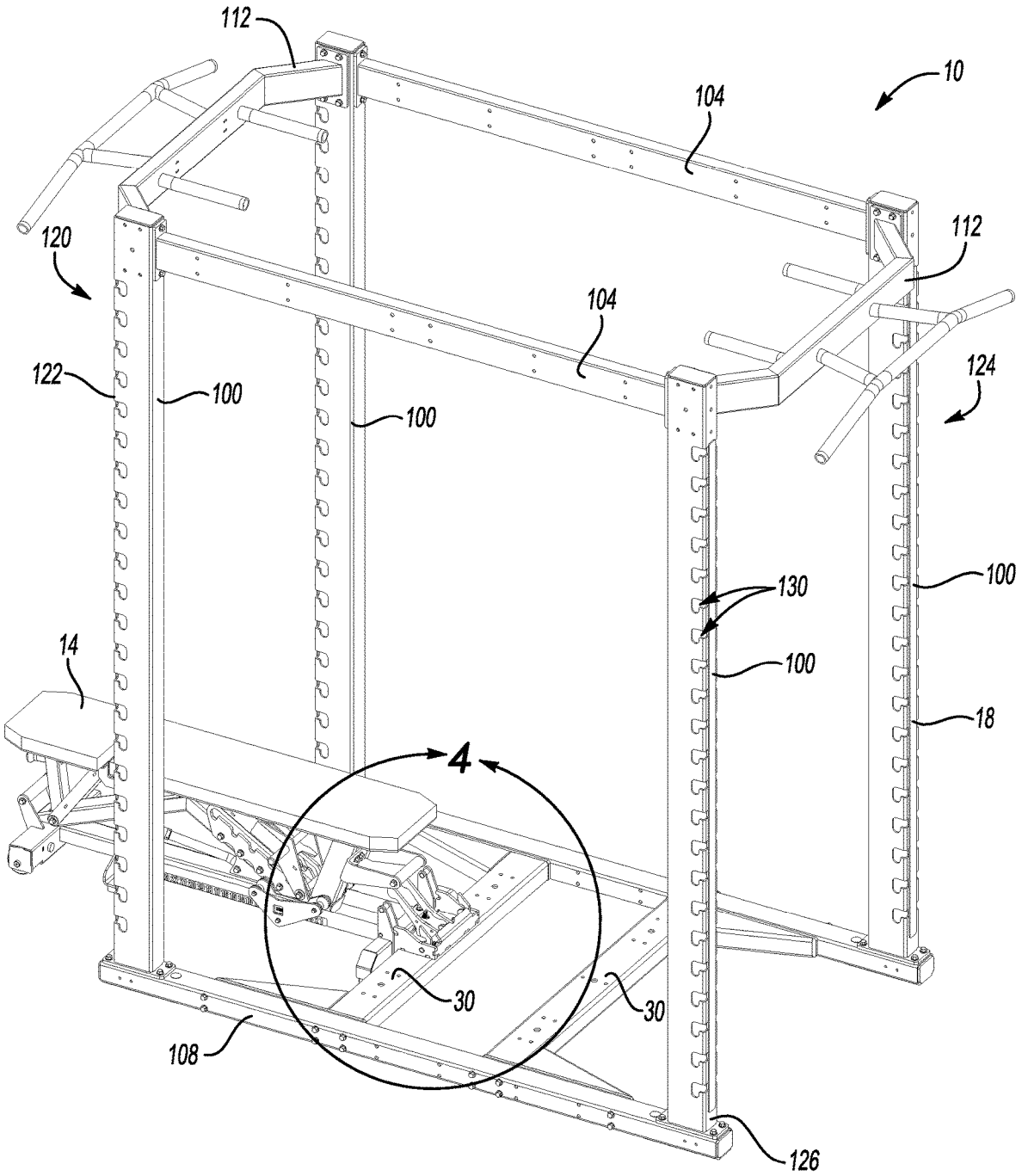
FIG. 1 illustrates a perspective view of a rack and a bench in a training position where a bench back and a bench seat are in a flat position.
Figure 2:
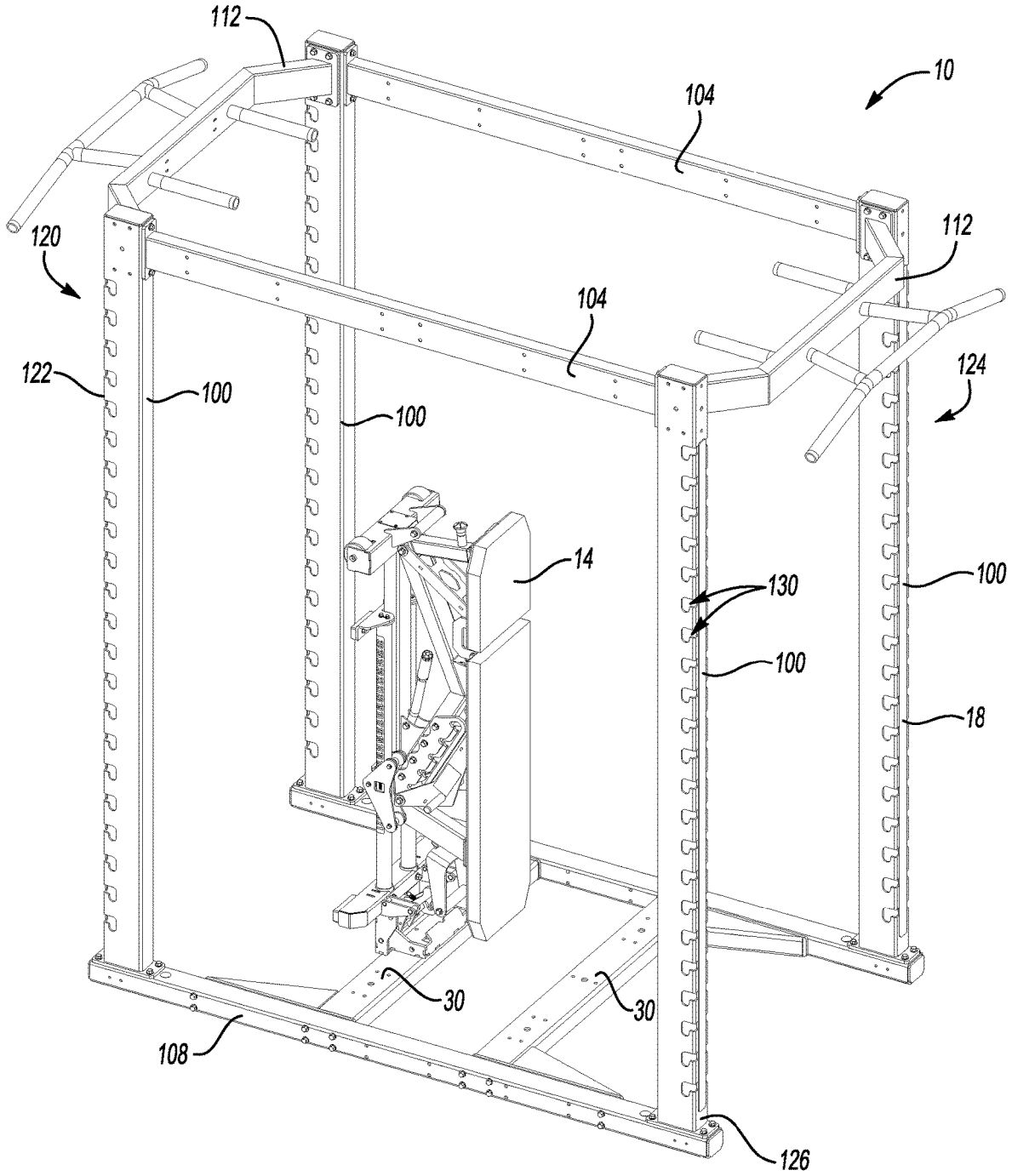
FIG. 2 illustrates a perspective view of the rack and the bench of FIG. 1 with the bench in a stored position.

Referring to FIGS. 1 and 2, an exercise system 10 includes a bench 14 and a rack 18. The bench 14 is attached directly to the rack 18. The bench 14 can be rotated back and forth between a training position shown in FIG. 1 and a stored position shown in FIG. 2.

When in the training position, the bench 14 can be used to perform various exercises, such as bench presses. The exercises using the bench 14 can utilize free weights, for example, or weights that the user lifts off of the rack 18.

When in the stored position, the rack 18 can be used for various exercises that do not require the bench 14. Because the rack 18 is in the stored position, the exercises that do not require the bench 14 can be performed without interference from the bench 14.

Figure 3:
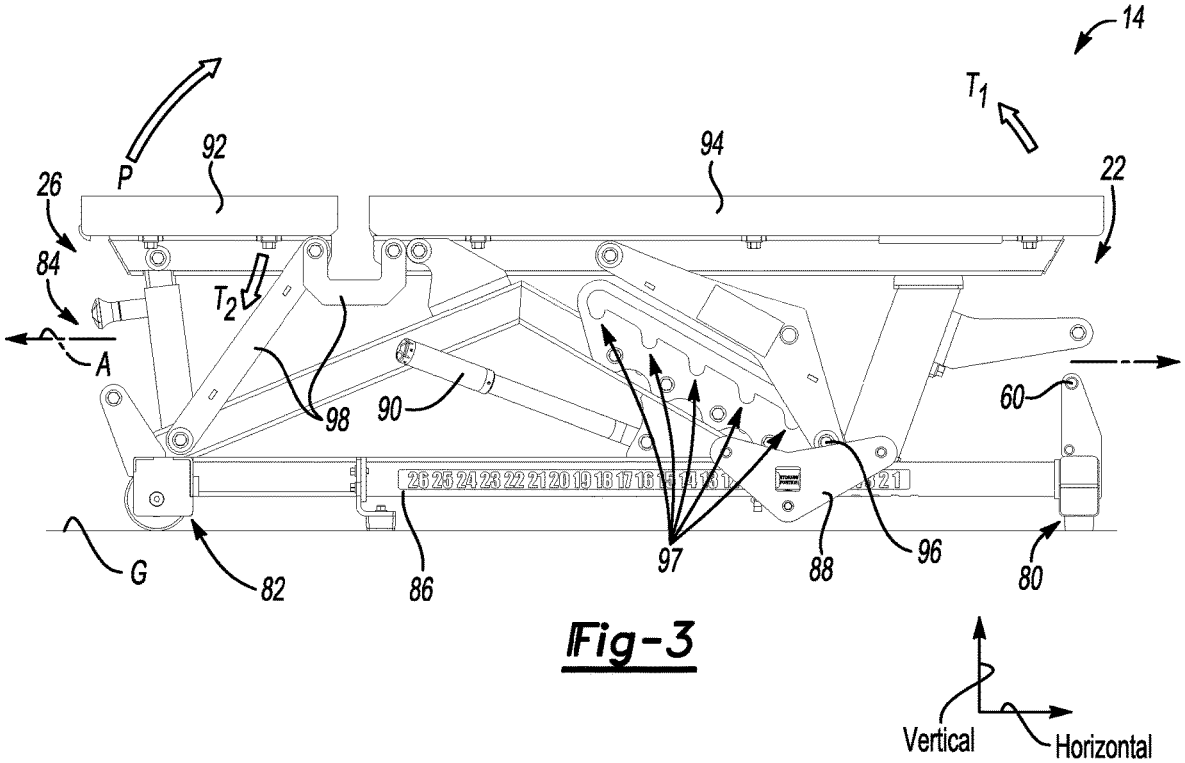
FIG. 3 illustrates a side view of the bench of FIG. 1.
Figure 4:
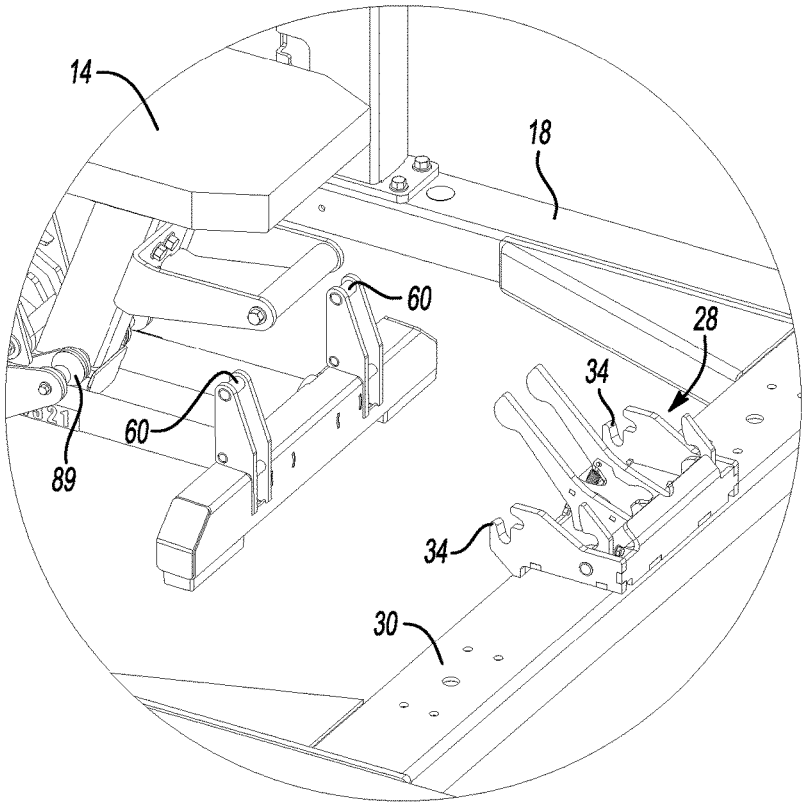
FIG. 4 illustrates a perspective view of a portion of the bench and a portion of the rack from FIG. 1 when the bench is detached from the rack.
Figure 5:
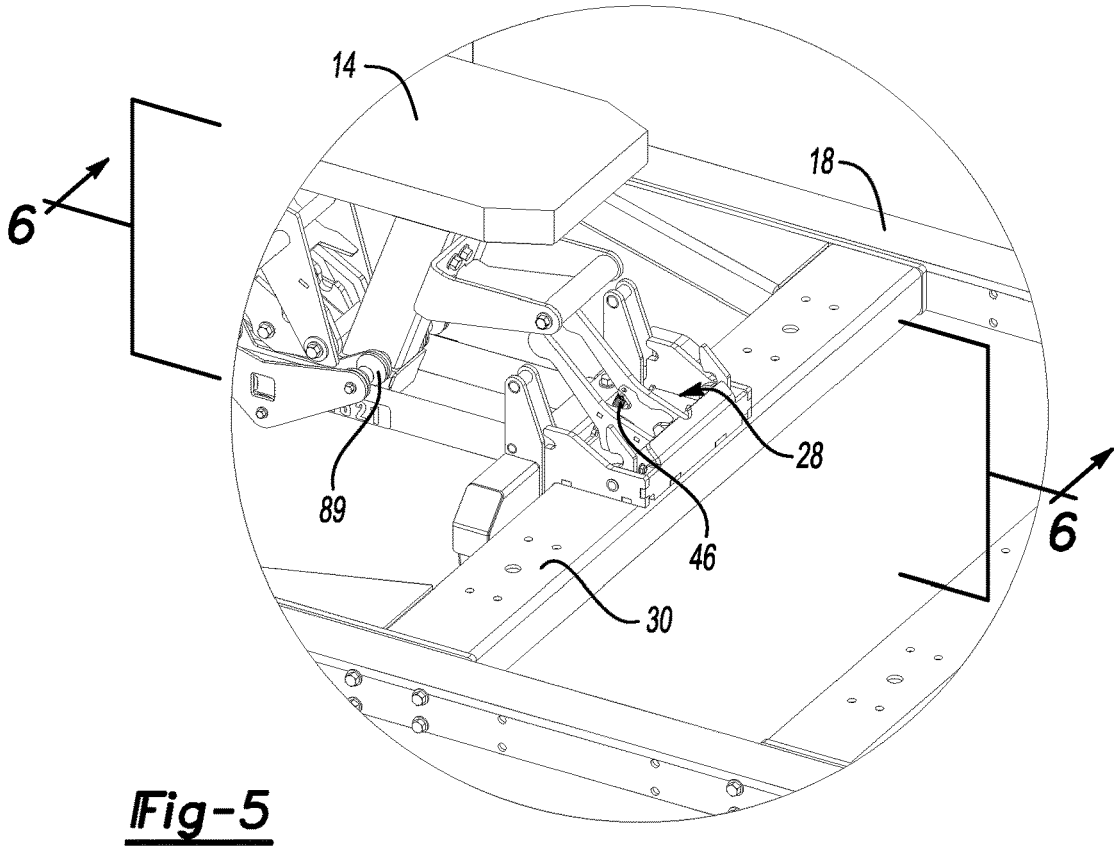
FIG. 5 illustrates the portions of the bench and the rack in from FIG. 4 when the bench is attached to the rack.
Figure 6:
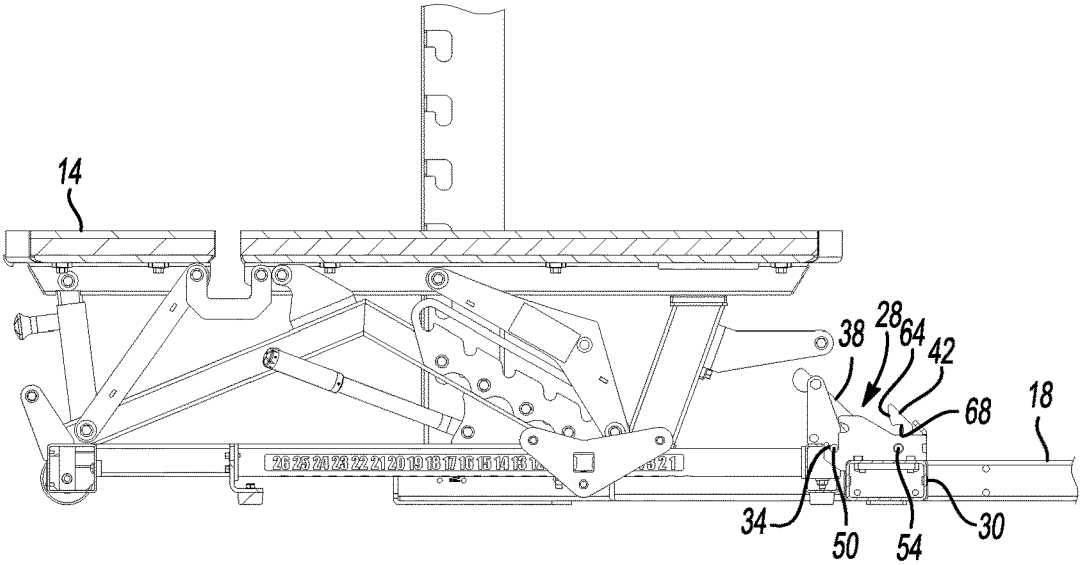
FIG. 6 illustrates a perspective section view of the bench and a portion of the rack taken at Line 6-6 in FIG. 5.

With reference now to FIG. 3 and continuing reference to FIGS. 1 and 2, the bench 14 extends along a longitudinal axis A from a first end portion 22 to a second end portion 26. When the bench 14 is attached to the rack 18, the bench 14 is pivotable in a direction P about the first end portion 22 to move the bench 14 back and forth between the training position and the stored position. In the exemplary embodiment, the bench 14 rotates ninety degrees about the first end portion 22 when transitioning from the training position to the stored position.

When the bench 14 is in the training position, the first end portion 22 and the second end portion 26 are vertically aligned. When the bench 14 is in the stored position, the first end portion 22 is vertically beneath the second end portion 26, and is substantially horizontally aligned with the first end portion 22. Vertical and horizontal, for purposes of this disclosure, are with reference to ground G and the ordinary orientation of the exercise system 10 during use.

With reference now to FIGS. 4-8, an attachment assembly 28 is mounted to a lower cross-member 30 of the rack 18. The attachment assembly 28 is used to attach the bench 14 to the rack 18. The attachment assembly 28 can be bolted to the cross-member 30 for example. Among other things, the attachment assembly 28 includes a pair of hooks 34, a release lever 38, a pair of latches 42, and at least one biasing member 46.

When the bench 14 is attached to the frame 18, each of the hooks 34 receives a pivot pin 50 of the bench 14. The pivot pins 50 rotate within the hooks 34 when the bench 14 back and forth between the training position and the stored position.

The release lever 38 and latches 42 are configured to rotate together about a pivot 54 of the attachment assembly 28. The biasing member 46, here a pair of coil springs, biases the release lever 38 in the latches 42 in a direction B about the pivot 54.

Figure 7:
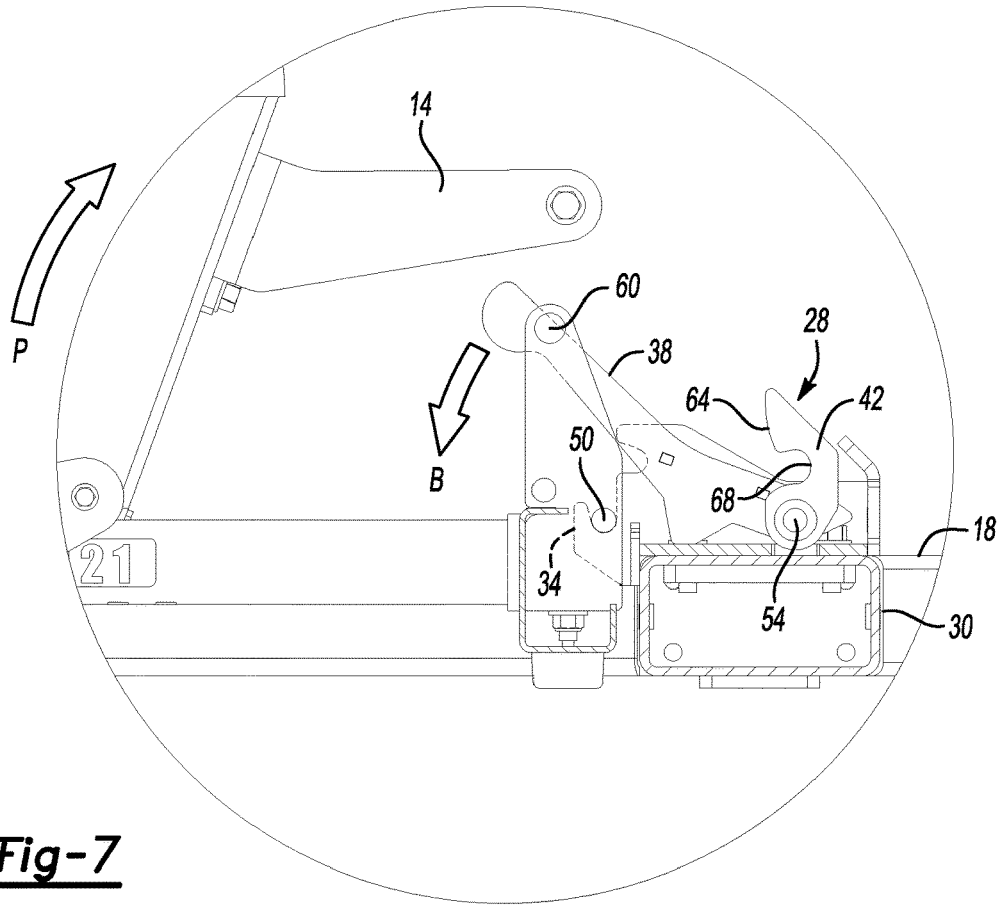
FIG. 7 illustrates a side view of the section of FIG. 6 when the bench is in the training position and with selected portions removed.
Figure 8:
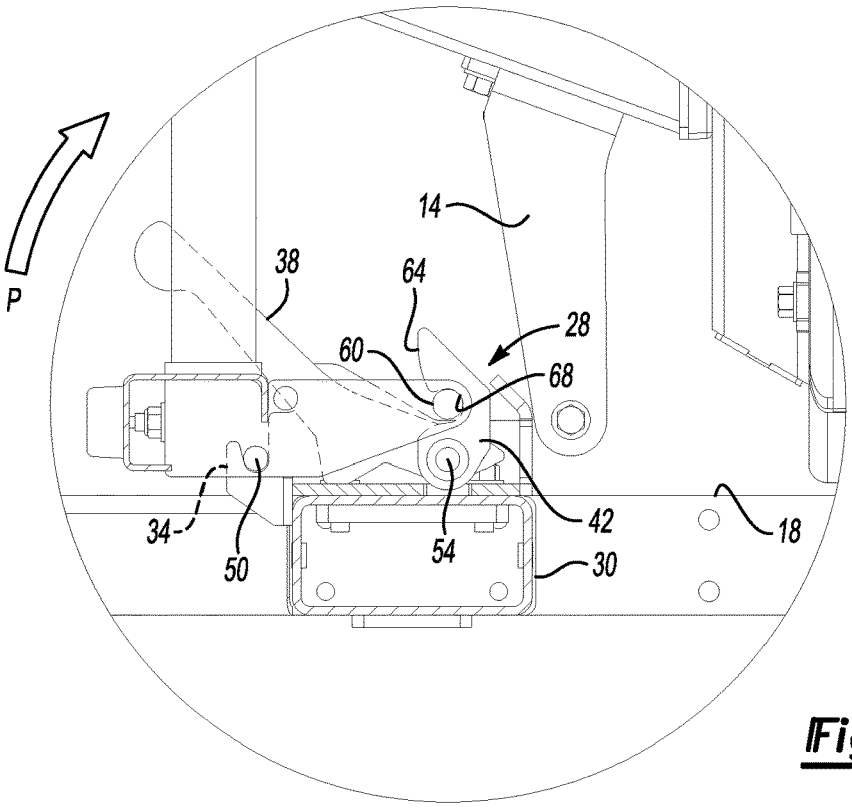
FIG. 8 illustrates the side view of the section in FIG. 7 when the bench is in the stored position.

As the bench 14 is pivoted in the direction P from the training position of FIG. 7 to the stored position of FIG. 8 about the pivot pins 50, a pair of lock pins 60 of the bench 14 come into contact with a surface 64 of one of the latches 42. As the bench 14 continues to pivot in the direction P, the lock pins 60 press against the surfaces 64 and overcome the biasing force of the biasing member 46. This rotates the latches 42 and the release lever 38 about the pivot 54 in a direction B and permits the lock pins 60 to slide along the surfaces 64 into respective notches 68 of the latches 42.

When the lock pins 60 slide off of the surfaces 64, the biasing member 46 causes the latches 42 to rotated back in the direction B such that the lock pins 60 are fully received within the notches 68 of the latches 42 as shown in FIG. 8. The latches 42 secure the bench 14 in the stored position when the latches 42 are in the position of FIG. 8. The biasing member 46 holds the latches 42 in this position.

To move the bench 14 from the stored position to the training position, a user can apply a force to the release lever 38 to overcome the biasing of the biasing member 46 and to rotate the release lever 38 about the pivot 54 in a direction opposite the direction B. The latches 42 move with the release lever 38 as the release lever 38 is rotated. Thus, moving the release lever 38 in a direction opposite the direction B causes the latches 42 to rotate away from the lock pins 60 such that the lock pins 60 moved from the notches 68.

Since the latches 42 no longer secure the lock pins 60, the user can the rotate the bench 14 past the surfaces 64 of the latches 42, release the release lever 38, and continue to rotate the bench 14 to the training position.

In some examples, the release lever 38 can move in response to the user applying a force to the release lever 38 with their foot.

With reference again to FIGS. 1-3, the bench 14 of the exemplary embodiment includes a first leg 80 at the first end portion 22, and a second leg 82 at the second end portion 26. The first leg 80 and the second leg 82 rest on the ground G when the bench 14 is in the training position. The first leg 80 and the second leg 82 are both elevated away from the ground G when the bench 14 is in the stored position.

The exemplary bench 14 is moveable along the longitudinal axis A back and forth between an extended position and a retracted position. The bench 14 can be moved along the longitudinal axis A to facilitate positing relative to the rack 18 during certain exercises, such as bench presses.

The bench 14 includes a bench base assembly 84 having at least one guide rail 86 and a roller assembly 88. In the exemplary embodiment, the roller assembly 88 includes roller wheels 89 that permit the roller assembly 88 to slide relative to the at least one guide rail 86 as the bench 14 is moved between the extended position and the retracted position.

A handle 90 could be actuated to move a toothed member to and from and engaged position with a plurality of slots on an underside of the base assembly 84. The toothed member in the engaged position can prevent the roller assembly 88 from sliding relative to the at least one guide rail 86. That is, actuating the handle 90 to disengage the toothed member from one or more of the slots may be required before moving the bench 14 between the extended position and the retracted position.

The bench 14 further includes a bench seat 92 and a bench back 94 atop the bench base assembly 84. The bench seat 92 and the bench back 94 are each moveable relative to the bench base assembly 84 back and forth between the flat position shown in FIG. 3 and a tilted position. In this example, the bench back 94 can be moved to one of a plurality of fixed tilted positions by positioning a portion of a bench back support member 96 within one of a plurality of slots 97. The slots 97 support the member 96 to support the bench 14 at a one of a plurality of fixed tilt locations.

The bench seat 92 and the bench back 94 are coupled to tilt together through a bracket assembly 98. That is, as the bench pack 94 is tilted in a direction $T_1$, the bracket assembly 98 tilts the bench seat 92 in a direction $T_2$.

An exemplary method of storing the bench 14 includes securing the first end portion 22 to the rack 18. The method then pivots the bench from a training position to a stored position where the second end portion 26 is vertically above the first end portion 22. In the training position, the first leg 80 and the second leg 82 rest on the ground G. In the stored position, the first leg 80 and the second leg 82 are elevated off of the ground G.

The method can include holding the bench 14 in the stored position by engaging the lock pins 60 with latches 42 (see FIG. 8). When the bench 14 is in the stored position, the user can rotate the release lever 38 to cause the latches 42 to release the lock pins 60 so that the bench 14 can move to the training position. The user may apply use their foot to apply a force to the release lever 38.

Referring again to FIG. 1, the rack 18 can be used to mount various weight arm systems and other exercise accessories, in addition to the bench 14.

The rack 18 of the exemplary embodiment includes four vertically extending uprights 100, a pair of upper supports 104, a pair of lower supports 108, a pair of upper cross-members 112, and a pair of the lower cross-members 30. Generally, the rack 18 provides a first exercise area 120 opening to a first side 122 of the rack 18, and a second exercise area 124 opening to an opposite, second side 126 of the rack 18.

Each of the upper supports 104 joins together an upper end portion of one of uprights 100 on the first side 122, and an upper end portion of one of the uprights 100 on the second side 126. Each of the lower supports 108 joins together a lower end portion of one of uprights 100 on the first side 122, and a lower end portion of one of the uprights 100 on the second side 126.

One of the upper cross-members 112 spans two of the uprights 100 on the first side 122, and the other upper cross-member 112 spans the other two of the uprights 100 on the second side 126. The upper cross-members 112 are used to secure chin-up and pull-up type exercise accessories in the example embodiment.

The uprights 100 each include a plurality of openings 130. Exercise devices such as weight arms and weight hooks can be secured to the uprights 100 by engaging the uprights 100 through one or more of the openings 130.

In this example, each opening 130 within one of the uprights 100 is separated from the next adjacent opening 130 by approximately four inches to provide significant incremental adjustment. Other examples could utilize other separation distances between the openings 130.

The uprights 100 extend longitudinally in a vertical direction. The uprights 100 are generally rectilinear in shape and is can be manufactured of tubing which is rectangular in cross-section.

Each opening 130 spans the intersection of a front face of the associated upright 100 and one of the side faces. In other words, each opening 130 cuts through the corner of the uprights 100.

Each of the lower cross-members 30 joins together the lower supports 108. One of the lower cross-members 30 is associated with the first exercise area 120, and the other of the lower cross-members 30 is associated with the second exercise area 124. The lower cross-members 30 are recessed within the exercise areas 120 and 120 relative to the uprights 100. Recessing the lower cross-members 30 can help to avoid a user tripping on the lower cross-members 30 when exercising.

The bench 14 secures to one of the lower cross-members 30 in this example and, when in the training position, is disposed within the first exercise area 120. Another bench (not shown) could be secured to the other one of the lower cross-members 30 and such that the other bench is disposed within the second exercise area 124 when in the training position.

The exemplary rack 18 could thus support users simultaneously exercising in both the first exercise area 120 and the second exercise area 124. For example, a first user could be performing squatting exercises within the first exercise area 120 with the bench 14 in the stowed position. The bench 14 could be folded to the stored position such that the bench 14 does not interfere with the squatting exercises. At the same time, a second user could be performing bench presses in the second exercise area 124 using a bench in a training position.

If the first user then wants to switch over to exercise that require the bench 14, the first user can transition the bench 14 from the stored position to the training position. The bench 14 being secured to one of the lower cross-members 30 facilitates a relatively smooth transition as the first user does not need to retrieve the bench 14 from outside the first exercise area 120, or spend considerable time adjusting the bench 14 laterally within the first exercise area 120.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

What is claimed is:

1. An exercise system, comprising:

a bench extending longitudinally from a first end portion to a second end portion, the bench pivotable about the first end portion from a training position to a stored position when the bench is attached to a rack, wherein the bench includes a bench seat and a bench back secured to a bench base assembly, the bench seat and the bench back moveable relative to the bench base assembly back and forth between a flat position and a tilted position, wherein the bench is moveable along the longitudinal axis when the bench is in the training position back and forth between an extended position and a retracted position; and a lever, wherein, when the bench is in the stored position, the lever holds a pin to secure the bench in the stored position, wherein the lever is biased toward an engaged position where the lever is configured to hold the pin.

2. The exercise system of claim 1, wherein the first end portion is vertically beneath the second end portion when the bench is in the stored position.

3. The exercise system of claim 1, wherein the bench rotates ninety degrees about the first end portion when transitioning from the training position to the stored position.

4. An exercise system, comprising:

a bench extending longitudinally from a first end portion to a second end portion, the bench pivotable about the first end portion from a training position to a stored position when the bench is attached to a rack, wherein the bench is moveable along the longitudinal axis when the bench is in the training position back and forth between an extended position and a retracted position;

a lever, wherein, when the bench is in the stored position, the lever holds a pin to secure the bench in the stored position; and at least one leg of the bench, the at least one leg resting on a surface to support at least a portion of the bench when the bench is in the training position, the at least one leg elevated away from the surface when the bench is in the stored position.

5. The exercise system of claim 4, wherein the lever is biased toward an engaged position where the lever is configured to hold the pin.

6. The exercise system of claim 5, wherein the lever is configured to be moved away from the engaged position by a force applied by a user.

7. The exercise system of claim 6, wherein the force is configured to be applied by a foot of a user.

8. The exercise system of claim 1, further comprising at least one leg of the bench, the at least one leg resting on a surface to support at least a portion of the bench when the bench is in the training position, the leg elevated away from the surface when the bench is in the stored position.

9. The exercise system of claim 1, wherein the base bench assembly further includes at least one guide rail and a plurality of rollers, the plurality of rollers sliding relative to the at least one guide rail as the bench is moved between the extended position and the retracted position.

10. The exercise system of claim 1, wherein the bench seat and the bench back are configured to move together between the flat position and the tilted position.

11. The exercise system of claim 1, wherein the tilted position is one a plurality of fixed tilted positions.

12. A method of storing a bench, comprising:

securing a first end portion of the bench to a rack, the bench extending longitudinally from the first end portion to a second end portion;

pivoting the bench from a training position to a stored position while the first end portion is attached to the rack; and holding the bench in the stored position by engaging a bar with a lever, the lever biased toward an engaged position with the bar, wherein, when the bench is in the stored position, the lever is configured to rotate from the engaged position so that the bench can rotate from the stored position to the training position, wherein the lever is configured to move from the engaged position in response to a force applied by a foot of the user, wherein the first and second end portions are vertically aligned when the bench is in the training position, wherein the second end portion is vertically above the first end portion when the bench is in the stored position.

13. The method of claim 12, further comprising transitioning the bench back and forth between a retracted position and an extended position when the bench is in the training position and is attached to the rack.

14. The method of claim 12, further comprising tilting a bench seat and a bench back relative to a bench base assembly when the bench is in the training position and is attached to the rack, the tilting moving the bench seat and the bench back relative to the bench base assembly back and forth between a flat position and a tilted position.

* * * * *